US007536730B2

(12) United States Patent
Estrella

(10) Patent No.: US 7,536,730 B2
(45) Date of Patent: May 26, 2009

(54) FOURCHETTE FOR STRETCHABLE GLOVES

(75) Inventor: Ranella Maniable Estrella, Seattle, WA (US)

(73) Assignee: Outdoor Research, Seattle, WA (US)

( * ) Notice: Subject to any disclaimer, the term of this patent is extended or adjusted under 35 U.S.C. 154(b) by 141 days.

(21) Appl. No.: 11/165,622

(22) Filed: Jun. 22, 2005

(65) Prior Publication Data

US 2007/0006362 A1 Jan. 11, 2007

(51) Int. Cl.
*A41D 19/02* (2006.01)

(52) U.S. Cl. ..... 2/169; 2/159; 2/160; 2/161.1

(58) Field of Classification Search ..... 2/159, 2/160, 161.6, 161.1, 161.2, 161.3, 163, 167, 2/169

See application file for complete search history.

(56) References Cited

U.S. PATENT DOCUMENTS 2,226,604 A * 12/1940 Geissmann ..... 2/169
2,447,951 A * 8/1948 Lindfelt ..... 2/167
2,504,553 A * 4/1950 Lindfelt ..... 2/167
2,545,272 A * 3/1951 Geissmann ..... 2/169
2,700,770 A * 2/1955 Stanton ..... 2/159
4,525,877 A * 7/1985 Chong ..... 2/161.1
5,560,044 A * 10/1996 Masley ..... 2/161.6
6,732,378 B2 * 5/2004 Novak ..... 2/161.6

OTHER PUBLICATIONS

"Fleece Handwear", Handwear, www.orgear.com, pp. 17-22, 2004.
"UnderGloves", Handwear, www.orgear.com, pp. 35-41, 2003.

* cited by examiner

*Primary Examiner*—Gary L. Welch
*Assistant Examiner*—Alissa J Tompkins
(74) *Attorney, Agent, or Firm*—Black Lowe & Graham PLLC

(57) ABSTRACT

A glove formed of a flexible fabric, such as a natural or synthetic knit fabric, provides anterior and posterior portions having the outline of the phalanges and metacarpals of a human hand. A fourchette joins the anterior and posterior portions to one another. The fourchette has an arcuate shape prior to securement to the glove and thereby tends to curve the phalangeal portions of the glove. The fourchette extends to the lower edge of the cuff. Joints between the fourchette and the anterior and posterior portions maintain an opening formed by the cuff in an open position.

10 Claims, 4 Drawing Sheets

FOURCHETTE FOR STRETCHABLE GLOVES

PRIORITY CLAIM

1. Field of the Invention

This invention relates generally to gloves and, more specifically, to gloves made of knit fabrics or other stretchable materials.

2. Background of the Invention

A typical glove will include anterior and posterior portions having an outline approximating the shape of a hand. In one type of construction, a thin strip of material, or fourchette, extends between the anterior and posterior portions in the finger region of the glove in order to define a volume for receiving the fingers of a user. A cuff surrounds the wrist of a user and is typically formed by the lower portions of the anterior and posterior portions. In prior systems, the fourchette terminates before reaching the cuff.

In such systems, the opening formed by the cuff tends to remain closed inasmuch as the fabric tends to collapse the opening. This is especially true of gloves formed of more flexible materials, such as knit fabrics and other stretchable materials. Such materials have virtually no ability to retain their shape. Users of such gloves must therefore expand the opening before inserting the hand, resulting in some inconvenience.

It would therefore be an advancement in the art to provide a glove made of a flexible material having a cuff that readily remains open to receive the hand of a user.

SUMMARY OF THE INVENTION

The present invention comprises a glove having both anterior and posterior portions each having phalangeal, metacarpal, and cuff portions corresponding to the parts of the human hand. A fourchette secures portions of the perimeter of the anterior and posterior portions to one another. The anterior and posterior portions and the fourchette may be formed of a flexible material such as a knit or stretch woven material made of natural fiber or synthetic fiber, such as polyester fleece. In one embodiment, the fourchette extends to the edge of an opening formed by the fourchette and the anterior and posterior portion. The fourchette may be the primary means proximately securing the cuff portion of the anterior portion to the cuff portion of the posterior portion. In one embodiment, the fourchette extends along both the ulnar and radial sides of the anterior and posterior portions. A thumb portion secures to the anterior portion and to the fourchette, with the fourchette extending between the thumb portion and the posterior side.

The fourchette may be formed of a piece of material of substantially constant thickness cut or formed in a thin strip of material forming an arc when the material is undeformed. The fourchette extends between the anterior and posterior portion and biases the phalangeal portion toward a curved orientation. The fourchette may include substantially straight portions secured to the metacarpal and cuff portions of the anterior and posterior portions. The fourchette may further include wide and narrow portions. The narrow portions being secured to the anterior and posterior portions proximate the distal ends of the phalangeal portions thereof. The fourchette may be formed in multiple pieces joined together. In one embodiment, the pieces are joined together near the phalangeal portion of the anterior and posterior portions.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
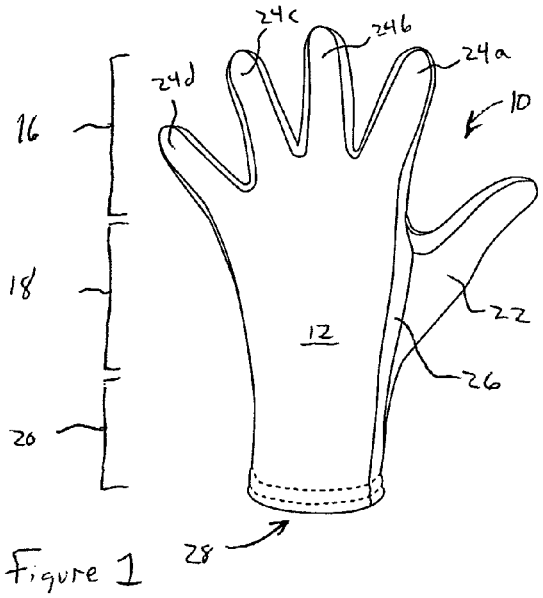
FIG. 1 is a rear elevation view of the posterior portion of a glove, in accordance with one embodiment of the present invention.
Figure 2:
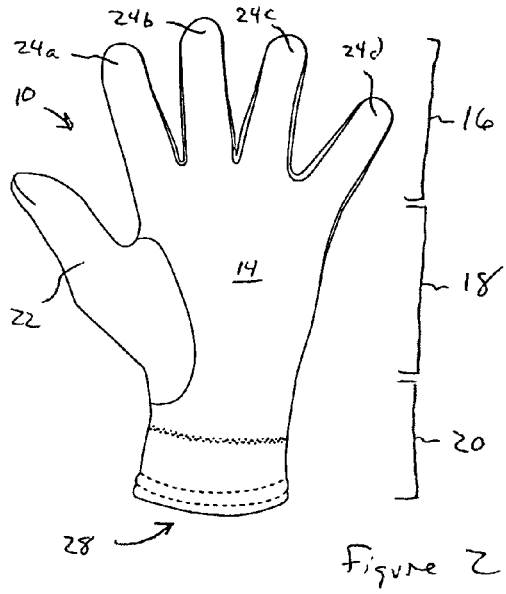
FIG. 2 is a front elevation view of the anterior portion of a glove, in accordance with one embodiment of the present invention.

Referring to FIGS. 1 and 2, a glove 10 may include a posterior portion (FIG. 1) 12 and an anterior portion 14 (FIG. 2). The posterior portion 12 and anterior portion 14 may each include a phalangeal portion 16, a metacarpal portion 18, and a cuff portion 20, corresponding to the phalanges, metacarpals, and wrist of a human hand. A thumb portion 22 may secure to the metacarpal portions 18. The phalangeal portion 16 may include four finger portions 24*a*-24*d*. However, in some embodiments, phalangeal portions 16 of the posterior portion 12 and anterior portion may be unitary, as in a mitten. Alternatively, a finger portion 24*a* accommodating the index finger may be formed whereas a second finger portion 24*b* accommodates the remaining fingers.

Figure 3:
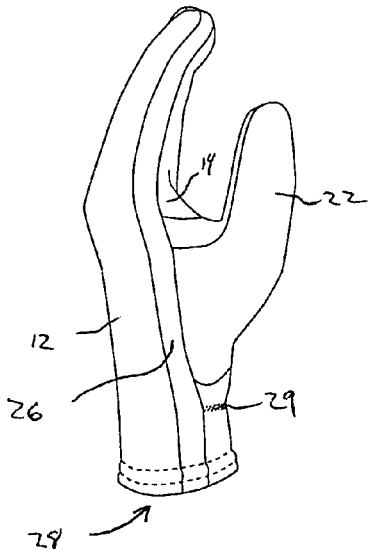
FIG. 3 is a radial side elevation view of a glove, in accordance with one embodiment of the present invention.
Figure 4:
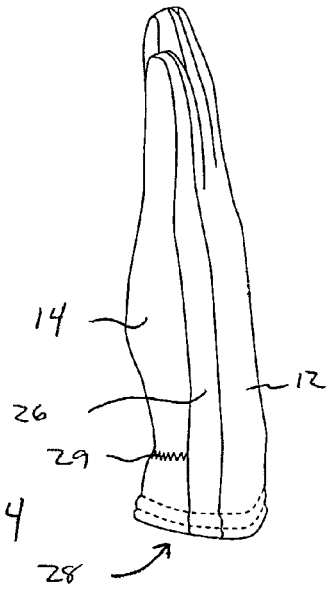
FIG. 4 is an ulnar side elevation view of a glove, in accordance with one embodiment of the present invention.

Referring to FIGS. 3 and 4, a fourchette 26 secures the posterior portion 12 to the anterior portion 14. The fourchette 26 is typically a thin band of fabric secured near its edges to the posterior portion 12 and the anterior portion 14 near the perimeters thereof. The fourchette 26 may be a single piece of material or multiple pieces of material. In one embodiment, the fourchette extends to the proximal end 28 of the glove 10 at both ulnar and radial sides of the glove 10. In the illustrated embodiment, the fourchette passes between the posterior portion 12 and the posterior side of the thumb portion 22, and secures the thumb portion 22 to the posterior portion 12. An elastic portion 29, gathered portion 29, or an elastic and gathered portion 29, may be located on the anterior portion on the cuff portion 20, extending from the radial to the ulnar side thereof and serve to retain the glove 10 on the wrist of the wearer.

Figure 5:
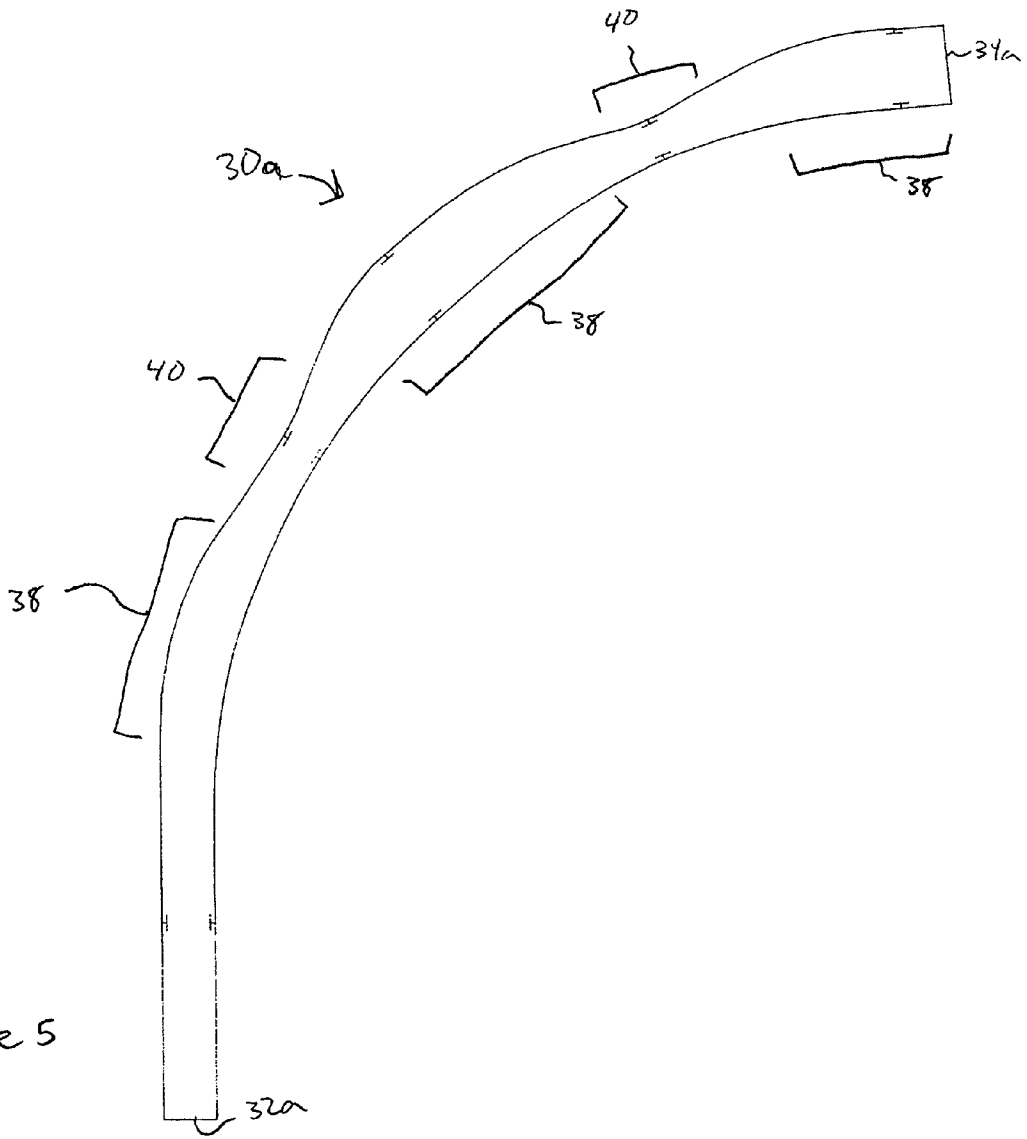
FIG. 5 is a plan view of a first fourchette, in accordance with one embodiment of the present invention.
Figure 6:
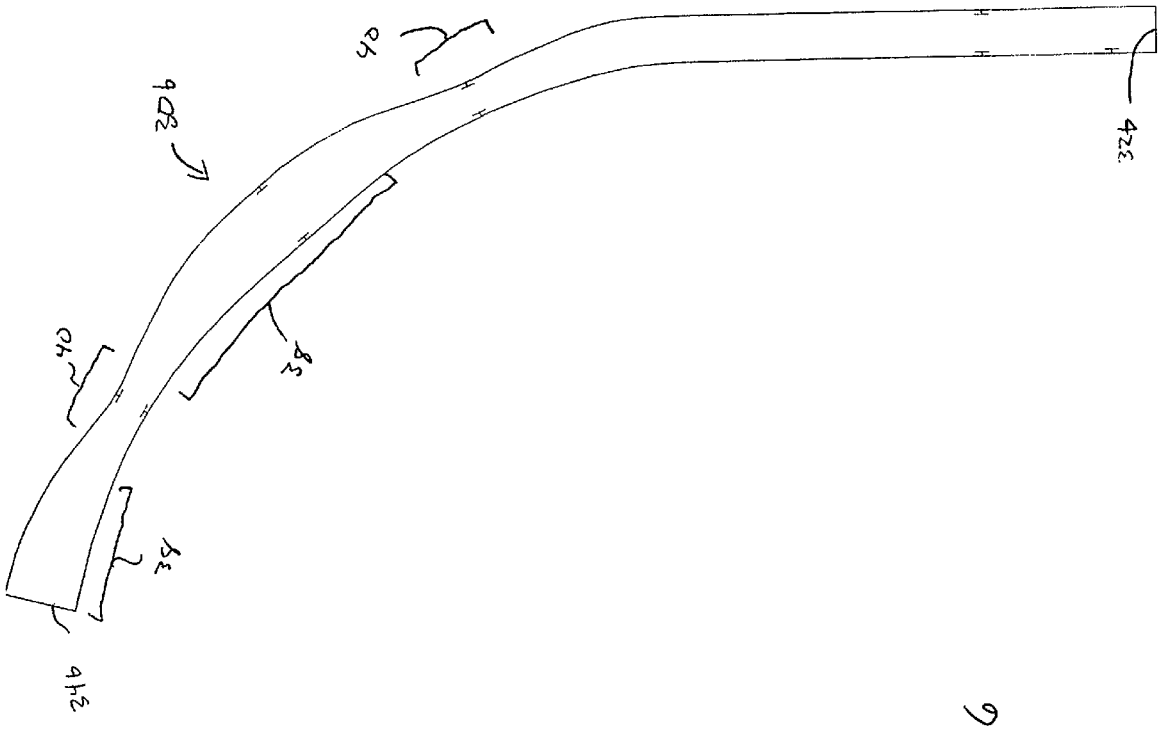
FIG. 6 is a plan view of a second fourchette, in accordance with one embodiment of the present invention.

Referring to FIGS. 5 and 6, while still referring to FIGS. 3 and 4, in the illustrated embodiment, the fourchette 26 is embodied as two separate sections, section 30*a* illustrated in FIG. 5, section 30*b* illustrated in FIG. 6. In the illustrated embodiment section 30*a* extends from the radial side near the proximal end 28 and over finger portions 24*a*, 24*b*. The section 30*b* extends from the ulnar side near the proximal end 28 and over finger portions 24*d*, 24*c*. In the illustrated embodiment, the ends 32*a*, 32*b* of the sections 30*a*, 30*b* are flush or substantially flush with the posterior portion 12 and anterior portion 14 at the proximal end 28 of the glove 10.

The ends 34*a*, 34*b* may secure to one another between the fingers 24*b*, 24*c*. However, other points of securement are possible, such as between other fingers 24*a*-24*d*, at the tip or side of a finger portion 24*a*-24*d*, or the like. Alternatively, the sections 30*a*, 30*b* may be monolithically formed as a single piece.

The sections 30*a*, 30*b* may have an arcuate shape having a radius of curvature. The radius of curvature is typically many times larger than the width of the sections 30*a*, 30*b*. In the illustrated embodiment, the ratio of the radius curvature to the width of the sections 30*a*, 30*b* at their widest point is approximately 9:1. In some embodiments, portions of the sections 30*a*, 30*b* near the ends 32*a*, 32*b* are substantially straight, rather than arcuate. Such straight portions typically join the metacarpal portions 18 and cuff portions 20 of the posterior and anterior portions 12,14.

The arcuate portions typically join the finger portions 24*a*-24*d*. The arcuate shape may serve to adapt the assembled glove to flexing of the fingers during use. The arcuate shape may also predispose the finger portions 24*a*-24*d* to curve in order to fit the natural curvature of the fingers of a user. The arcuate portion may further include widened portions 38 and narrowed portions 40. The widened portions 38 typically correspond to wider parts of the hands, such as at the base of the fingers. The narrowed portions 40 typically correspond to the finger tips.

Figure 7:
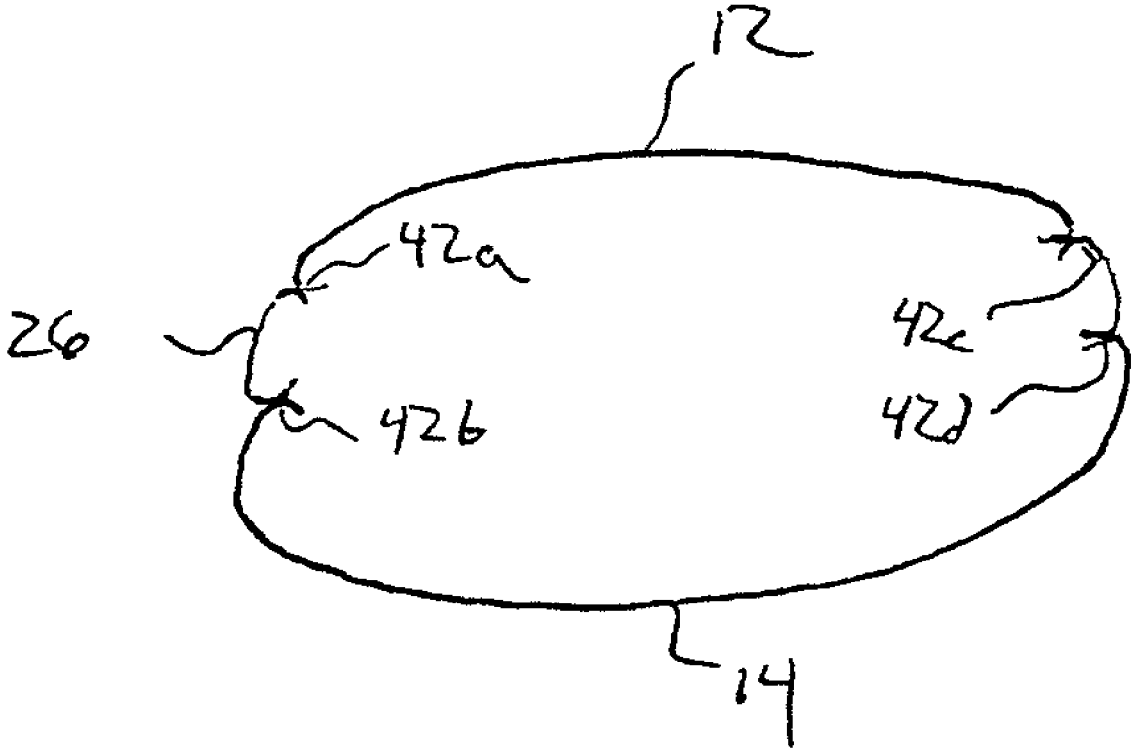
FIG. 7 is a bottom plan view of a glove, in accordance with one embodiment of the present invention.

Referring to FIG. 7, the configuration of the fourchette 26 may provide an advantage when putting on the glove 10. In prior gloves, the opening formed by the cuff tends to remain closed inasmuch as the fabric tends to collapse the opening. This is especially true of gloves formed of more flexible materials, such as knit fabrics, stretch woven materials, and other stretchable materials, which are extremely flexible. Users of such gloves must therefore expand the opening before inserting the hand, resulting in some inconvenience.

The disposition of the fourchette 26 at the cuff portion 20 in the present invention promotes ease of insertion as well as improved fit around the wrist of a wearer. In one embodiment, the fourchette 26 is stitched near or at the proximal end 28 of the posterior portion 12 and anterior portion 14 at both the ulnar and radial sides. In typical manufacturing methods, the edges of the fourchette 26 is stitched or otherwise attached, to the posterior portion 12 and anterior portion 14 and the assembled pieces are then inverted, leaving the joints 42*a*-42*d* between the pieces of material facing inwardly. Extending the fourchette 26 to the proximal end 28 of the posterior portion 12 and anterior portion 14 allows the joints 42*a*-42*d* to urge the cuff portion 20 of the glove 10 to remain open, thereby facilitating insertion of the hand.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A glove comprising:

an anterior portion and a posterior portion both having a perimeter corresponding to a shape of a hand, the perimeter defined approximately by ulnar and radial sides, a phalangeal portion, a metacarpal portion and a cuff portion;

a fourchette formed of a flexible and stretchable fabric and having substantially uniform thickness, the fourchette arranged as an elongated, convexo-concave strip, the strip having a first end and a second end, the concave portion coupled to the anterior portion and the convex portion coupled to the posterior portion, the convex and concave portions forming an arcuate strip curved alone at least the phalangeal portion on both anterior and posterior sides of the strip, at least the first end of the fourchette extending from at least one side of the cuff portion proximate a hand-insertion opening of the glove.

2. The glove of claim 1, further comprising a thumb portion secured to the anterior portion and the fourchette, the fourchette extending continuously from an index finger portion to the cuff portion, wherein a portion of the fourchette is located adjacent the thumb portion.

3. The glove of claim 2, wherein the fourchette includes narrowed width portion located proximate finger-tip end regions of the phalangeal portion.

4. The glove of claim 3, wherein the anterior portion and posterior portion are formed of a stretchable fabric.

5. The glove of claim 4, wherein the stretchable fabric is a knit fabric having a substantially constant thickness.

6. The glove of claim 4, wherein the stretchable fabric is a nylon polyester fabric.

7. The glove of claim 4, wherein the stretchable fabric is a stretch woven fabric.

8. The glove of claim 1, further comprising a second fourchette having a first end and a second end, the first end coupled to the fourchette proximate the phalangeal portion and the second end extending from the cuff portion.

9. The glove of claim 1, further comprising an elastic member deformably coupled to the cuff portion, the elastic member extending from the ulnar side of the cuff portion to the radial side of the cuff portion, the elastic member coupled to the fourchette.

10. A glove comprising:

an anterior portion and a posterior portion both having a perimeter corresponding to a shape of a hand, the perimeter defined approximately by ulnar and radial sides, a phalangeal portion, a metacarpal portion and a cuff portion;

an ulnar side fourchette formed of a flexible and stretchable fabric, the ulnar side fourchette arranged as an elongated, convexo-concave strip, the strip having a first end and a second end, the concave portion coupled to the anterior portion and the convex portion coupled to the posterior portion, the convex and concave portions forming an arcuate strip curved along at least the phalangeal portion on both sides of the strip, the first end of the strip located on an ulnar side of the cuff portion proximate a hand-insertion opening of the glove with the strip extending to the second end that is located approximately at a mid point of the phalangeal portion; and an radial side fourchette formed of a flexible and stretchable fabric, the radial side fourchette arranged as an elongated, convexo-concave strip, the strip having a first end and a second end, the concave portion coupled to the anterior portion and the convex portion coupled to the posterior portion, the convex and concave portions forming an arcuate strip curved along at least the phalangeal portion on both sides of the strip, the first end of the strip located on a radial side of the cuff portion proximate a hand-insertion opening of the glove and the second end coupled to the ulnar side fourchette.

* * * * *